US009631910B2

(12) United States Patent
Fricke

(10) Patent No.: US 9,631,910 B2
(45) Date of Patent: Apr. 25, 2017

(54) EXPANDING SUBSONIC PROJECTILE AND CARTRIDGE UTILIZING SAME

(71) Applicant: Lehigh Defense, LLC, Quakertown, PA (US)

(72) Inventor: David B. Fricke, Quakertown, PA (US)

(73) Assignee: Lehigh Defense, LLC, Quakertown, PA (US)

( * ) Notice: Subject to any disclaimer, the term of this patent is extended or adjusted under 35 U.S.C. 154(b) by 470 days.

(21) Appl. No.: 14/145,837

(22) Filed: Dec. 31, 2013

(65) Prior Publication Data

US 2016/0216090 A1 Jul. 28, 2016

(51) Int. Cl.
*F42B 12/34* (2006.01)
*F42B 5/02* (2006.01)

(52) U.S. Cl.
CPC ..... *F42B 12/34* (2013.01); *F42B 5/02* (2013.01); *F42B 5/025* (2013.01)

(58) Field of Classification Search
CPC .... F42B 5/00; F42B 5/02; F42B 5/025; F42B 12/00; F42B 12/02; F42B 12/34; F42B 30/02
USPC ..... 102/439, 501, 507, 508, 509, 510, 517, 102/518
See application file for complete search history.

(56) References Cited

U.S. PATENT DOCUMENTS 1,023,469 A * 4/1912 Haslett ..... F42B 12/34 102/510
1,096,558 A * 5/1914 Newton ..... F42B 12/34 102/508
1,155,901 A * 10/1915 Duncan ..... F42B 12/34 102/508
1,447,478 A * 3/1923 Koshollek ..... F42B 12/34 102/508
1,493,614 A * 5/1924 Dickerman ..... F42B 12/34 102/510
2,765,738 A 10/1956 Frech, Jr.
3,173,371 A 3/1965 Manshel
3,881,421 A * 5/1975 Burczynski ..... F42B 12/34 102/509
4,550,662 A 11/1985 Burczynski
4,776,279 A * 10/1988 Pejsa ..... F42B 12/34 102/510
5,385,101 A 1/1995 Corzine et al.
5,400,716 A 3/1995 Mayer
5,822,904 A * 10/1998 Beal ..... F42B 12/74 102/430
6,176,186 B1 1/2001 Engel
6,805,057 B2 10/2004 Carr et al.
(Continued)

FOREIGN PATENT DOCUMENTS

DE 2843167 A1 * 4/1980 ..... F42B 12/34

OTHER PUBLICATIONS http://web.archive.org/web/20121114031334/http://www.accurateshooter.com/ballistics/tangent-vs-secant-vs-hybrid-ogive-bullets/; published on the internet on Nov. 14, 2012.*
(Continued)

*Primary Examiner* — James S Bergin
(74) *Attorney, Agent, or Firm* — Merchant & Gould, PC

(57) ABSTRACT

An expanding subsonic projectile has a body having an ogive of greater than about 8 calibers. The body at least partially defines a hollow bore and a hydrostatic ram disposed proximate a first end of the bore.

23 Claims, 8 Drawing Sheets

(56) References Cited

U.S. PATENT DOCUMENTS

| | | | | |
|---|---|---|---|---|
| 6,845,717 | B1 * | 1/2005 | Sauvestre | F42B 12/34 102/510 |
| 6,971,315 | B2 | 12/2005 | Knappworst | |
| 7,360,491 | B2 * | 4/2008 | Sanborn | F42B 12/34 102/503 |
| 7,503,260 | B2 | 3/2009 | Kapeles | |
| 7,814,837 | B2 * | 10/2010 | Sauvestre | F42B 12/34 102/508 |
| 8,171,852 | B1 * | 5/2012 | Rebar | F42B 12/34 102/509 |
| 8,438,767 | B2 | 5/2013 | Rebar | |
| 9,003,974 | B2 * | 4/2015 | Muskat | F42B 12/02 102/507 |
| 9,341,455 | B2 * | 5/2016 | Fricke | F42B 12/34 |
| 2003/0019385 | A1 * | 1/2003 | LeaSure | F42B 5/025 102/444 |
| 2008/0216700 | A1 | 9/2008 | Martini Filho | |
| 2014/0318406 | A1 * | 10/2014 | Rall | F42B 33/001 102/510 |
| 2015/0354930 | A1 * | 12/2015 | Fricke | F42B 12/34 102/439 |
| 2016/0223307 | A1 * | 8/2016 | Bray | F42B 30/02 |

OTHER PUBLICATIONS

"Lehigh Defense 200 gr. Maximum Expansion Projectiles and Ammo" located online at: http://300blktalk.com/forum/viewtopic.php?f=151&t=79280, obtained on Nov. 26, 2013, 4 pgs.

"Maximum Expansion Bullets and Ammunition", located online at: http://www.lehighdefense.com/index.php/our-technology/maximum-expansion-bullets-and-ammunition#gel-images, obtained on Nov. 26, 2013, 2 pgs.

"Subsonic Bullets", located online at: http://www.corbins.com/subsonic.htm, obtained on Nov. 26, 2013, 5 pgs.

Williams, Anthony G., Tres Haute Vitesse, The Story of the THV and Monad Bullets, May 30, 2014, pp. 1-6, http://www.quarry.nildram.co.uk/THV.htm.

* cited by examiner

EXPANDING SUBSONIC PROJECTILE AND CARTRIDGE UTILIZING SAME

INTRODUCTION

Expanding projectiles direct significant stopping power at a target (e.g., game, enemy combatants) that can help ensure a clean kill of the target. Supersonic projectiles (that is, projectiles discharged from a weapon at greater than about 1040 fps), are propelled with sufficient force so as to expand when hitting any target regardless of projectile profile. Typically, such projectiles are manufactured of lead or copper-jacketed lead, both of which are sufficiently ductile to expand and deform when hitting virtually any barrier or target. The propulsion force of subsonic projectiles, however, is typically insufficient to expand when hitting a target, unless the projectiles are constructed with a fairly blunt profile. Such low caliber projectiles are unable to be fed via a magazine into an automatic or semi-automatic firearm.

SUMMARY

In one aspect, the technology relates to an expanding subsonic projectile having: a body that includes an ogive of greater than about 8 calibers, wherein the body at least partially defines a hollow bore; and a hydrostatic ram disposed proximate a first end of the bore. In one embodiment, the expanding subsonic projectile has an ogive in a range from about 8 calibers to about 13 calibers. In another embodiment, the expanding subsonic projectile has an ogive in a range from about 10 calibers to about 13 calibers. In yet another embodiment, the expanding subsonic projectile has an ogive is about 10.59 calibers. In still another embodiment, the expanding subsonic projectile contains a plurality of discrete petals, wherein each petal is separated from an adjacent leaf by a slot defined by the body.

In another embodiment of the above aspect, the expanding subsonic projectile has three petals. In an embodiment, the expanding subsonic projectile has four petals and the slots disposed between the petals are disposed about an axis of the body at about 0 degrees, about 90 degrees, about 180 degrees, and about 270 degrees. In another embodiment, the expanding subsonic projectile is adapted to expand greater than about 2 calibers when the projectile is discharged from a firearm at a subsonic speed into a wet target. In yet another embodiment, the expanding subsonic projectile includes a hydrostatic ram that is adapted to move axially within the bore when the projectile is discharged from a firearm at a subsonic speed into a wet target. In still another embodiment, the expanding subsonic projectile includes a monolithic construction. In another embodiment, the expanding subsonic projectile has a hydraulic ram that has a leading diameter and the bore has a bore diameter smaller than the ram diameter.

In another aspect, the technology relates to a cartridge having: a casing; a primer disposed at a first end of the casing; and a projectile disposed at a second end of the casing, wherein the projectile includes: a body having an ogive of greater than about 8 calibers, wherein the body at least partially defines a hollow bore; and a hydrostatic ram disposed proximate an open end of the bore. In an embodiment, the hydrostatic ram has a face and the face is set back from the open end of the bore. In another embodiment, the body has a body length and the bore has a bore depth about one-third of the body length. In yet another embodiment, the technology relates to a cartridge wherein the hydrostatic ram is adapted to move axially within the bore when the projectile is discharged from a firearm at a subsonic speed into a wet target. In still another embodiment, the projectile is adapted to expand greater than about 2 calibers when the projectile is discharged from a firearm at a subsonic speed into a wet target.

In an embodiment of the above aspect, the body includes a plurality of adjacent petals, wherein adjacent petals at least partially define a slot therebetween. In another embodiment, each slot defines a radius extending from the bore to an outer surface of the body. In yet another embodiment, the slot defines a slot length and the bore depth is about two-thirds of the slot length. In still another embodiment, the slot length is about one-half of the body length.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
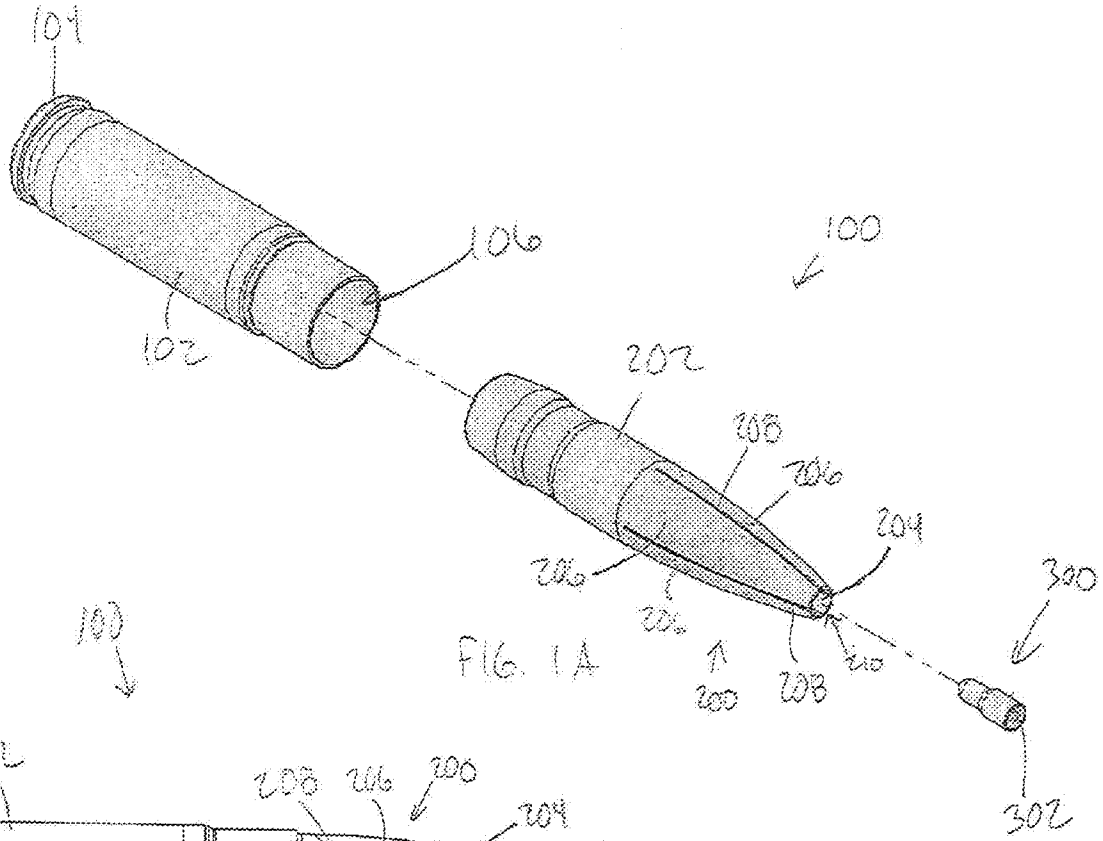
FIG. 1A is an exploded perspective view of an embodiment of a cartridge utilizing a expanding subsonic projectile.
Figure 1B:
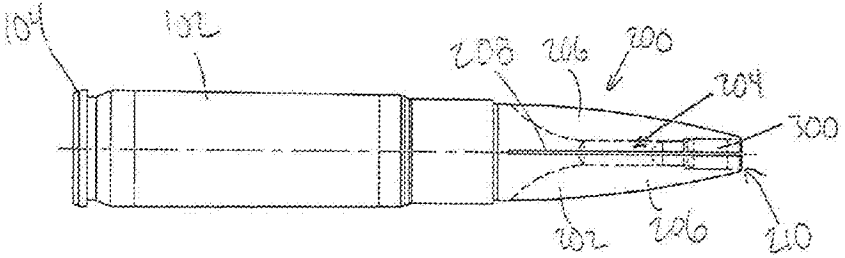
FIG. 1B is a side view of the cartridge of FIG. 1A.
Figure 2B:
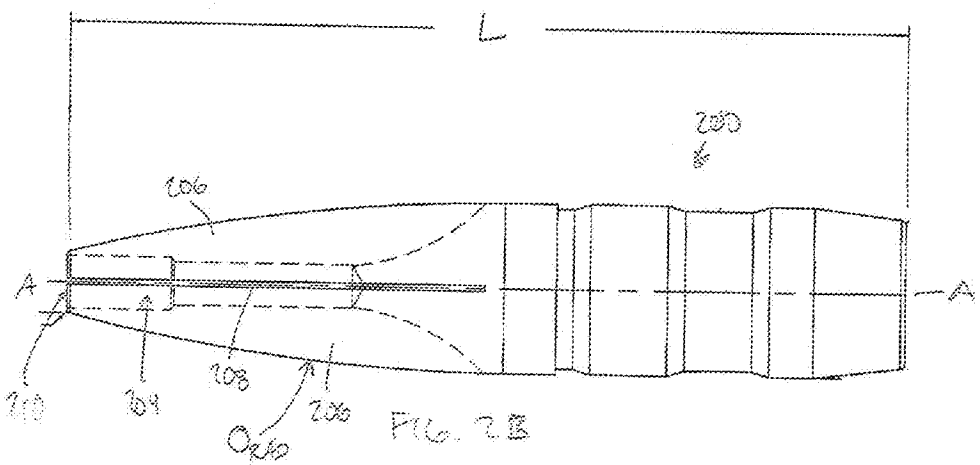
FIG. 2B is a side view of the expanding subsonic projectile of FIG. 2A.
Figure 2D:
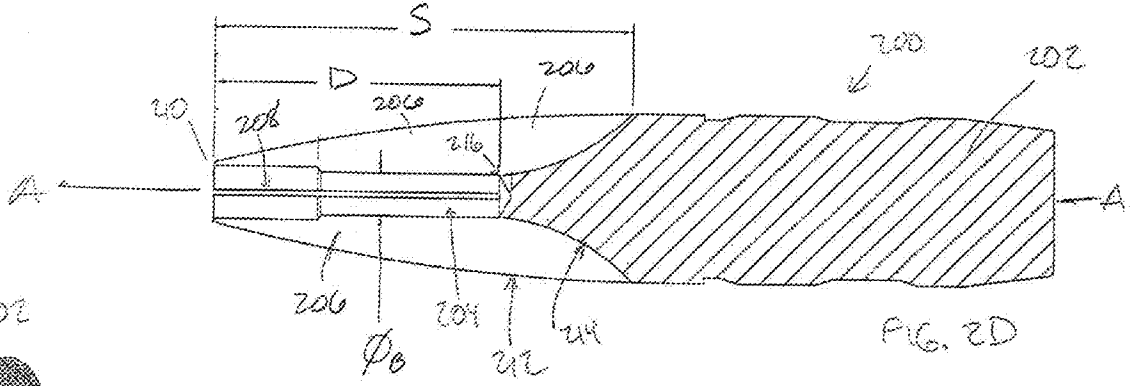
FIG. 2D is a side sectional view of the expanding subsonic projectile of FIG. 2A.
Figure 2C:
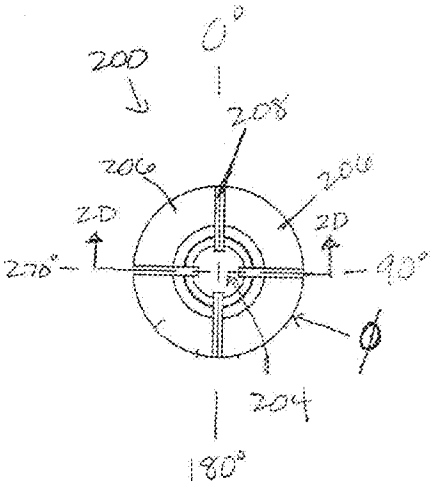
FIG. 2C is an end view of the expanding subsonic projectile of FIG. 2A.
Figure 2A:
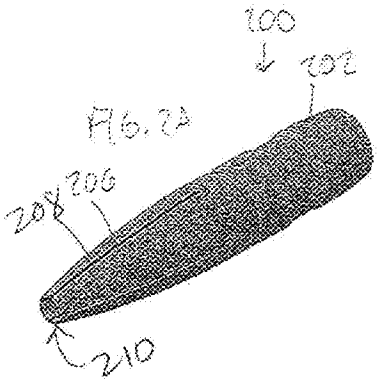
FIG. 2A is a perspective view of an embodiment of an expanding subsonic projectile.

FIGS. 1A and 1B depict views of a cartridge 100 utilizing an expanding subsonic projectile 200. The cartridge 100 includes an annular casing 102 having a primer (not shown) disposed at a first end 104 thereof, as well-known in the art. The casing 102 includes an open second end 106 into which the projectile 200 is inserted during manufacture and assembly. The interior of the casing 102 is filled with a propellant (e.g., gunpowder) that is ignited by the primer. This ignition discharges the projectile 200 from a firearm, such as a rifle. In so-called "automatic weapons," the force of the explosion is sufficient to both discharge the projectile and cycle a new cartridge into the weapon's firing chamber. The projectile 200 includes a body 202 that at least partially defines a hollow bore 204 that is open at a distal end 210 of the projectile 200. The bore 204 is surrounded by a plurality of petals 206. Adjacent petals 206 are spaced from each other by slots 208. The construction and performance of the projectile 200 is described in further detail herein. A hydraulic ram 300 is disposed proximate the distal end 210 of the projectile 200 such that a face 302 of the ram 300 is set back from the distal end 210 of the bore 204. The construction and performance of the ram 300 is described in further detail herein.

FIGS. 2A-2D depict various views of an expanding subsonic projectile 200, in accordance with one embodiment of the technology. As described in brief above, the projectile 200 includes a body 202 having a plurality of petals 206 surrounding a hollow bore 204 that is open at a distal end 210 of the projectile 200. The petals 206 are separated from each other by slots 208.

The projectile body 202 has a length L and a caliber Ø. The bore 204 has a depth D, as measured along an axis A of the projectile body 202, from the distal end 210. The bore 204 comprises a bore diameter $O_B$. The depicted projectile body 202 includes four petals 206, separated by an equal number of slots 208. In other embodiments, a greater or fewer number of petals may be utilized as required or desired for a particular application. Projectiles having as few as three or as many as eight petals are contemplated. As can be seen specifically in FIG. 2C, the slots 208 are disposed at equal distances about the axis A of the body 202. Specifically, they are disposed at about 0°, about 90°, about 180°, and about 270°. Uneven spacing may also be utilized, although such a configuration may adversely affect expansion of the projectile as it strikes a target. The slots 208 extend from an outer surface 212 of the petals 206 and intersect the bore 204. At the base 216 of the bore 204, the slots 208 are formed by a radius 214 that extends from the base 216 of the bore 204 to the outer surface 212 of the body 202. This radius 214 forms a portion of a length S of each slot 208, such that the petals 206 may more easily expand when hitting a target. The length S is measured from the distal end 210 of the body 202. The petals 206 define an ogive radius $O_{RAD}$ of the projectile 200, as described in further detail below.

The various dimensions described above (body length L and caliber Ø, bore depth D and diameter $Ø_B$, slot length S, and ogive radius $O_{RAD}$) may be modified as required or desired for a particular application. Certain ratios have been discovered to be particularly beneficial for projectiles with an ogive between about 8 and about 13 calibers. For example, the bore depth D may be about one-third of the body length L. The bore depth D may be also about two-thirds of the slot length S. The slot length S may be about one-half the body length L. Other dimensional relationships are contemplated. The dimensions of the various elements of the disclosed projectiles assist in enabling those projectiles to expand when hitting a target, after being discharged from a weapon at a subsonic speed.

Figure 3C:
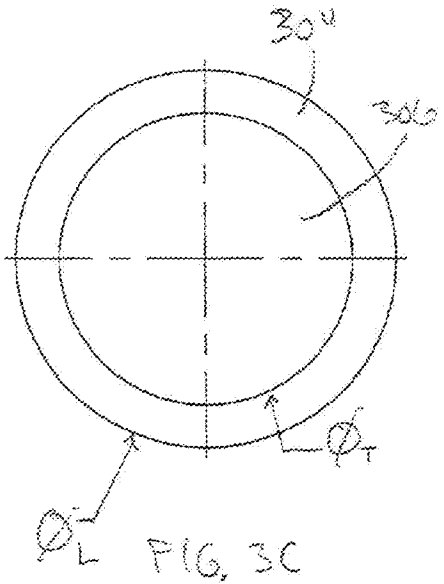
FIG. 3C is an end view of the hydraulic ram of FIG. 3A.
Figure 3B:
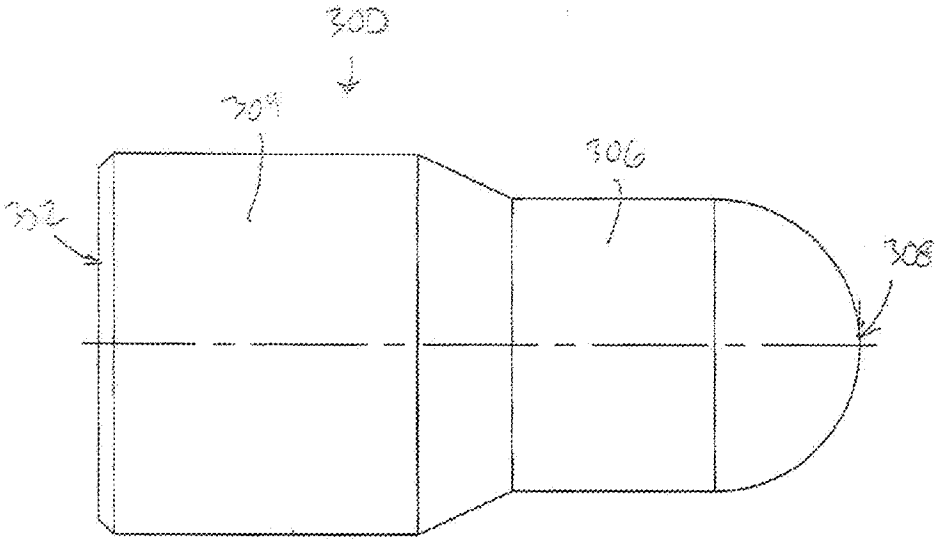
FIG. 3B is a side view of the hydraulic ram of FIG. 3A.
Figure 3A:
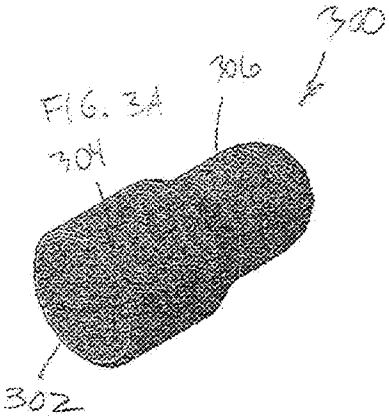
FIG. 3A is a perspective view of an embodiment of a hydraulic ram.

FIGS. 3A-3C depict various views of hydraulic ram 300, in accordance with one embodiment of the technology. The ram 300 includes a face 302 disposed towards the distal end 210 of the projectile 202, when the ram 300 is inserted into the bore 204. The depicted ram 300 defines two body portions 304, 306. The leading portion 304 forms the face 302 and has a leading diameter $Ø_L$ that is greater than the bore diameter $Ø_B$. The trailing portion 306 includes a convex tail 308 that aids in insertion of the ram 300 into the bore 204 during assembly. The trailing portion 306 includes a trailing diameter $Ø_T$ that is substantially the same as the bore diameter $Ø_B$. This helps secure the ram 300 in the bore 204. The larger leading diameter $Ø_L$ (relative to the bore diameter $Ø_B$) initiates expansion of the petals 206 as the projectile 200 strikes a target. More specifically, the hydrostatic force associated with the target force the ram 300 rearward in the bore 204. As the petals 206 spread, the hydrostatic force acts further upon the slightly spread petals 206 forcing them to expand to, and past, their maximum expansion point, as the projectile advances in the target.

Typically, expanding projectiles are manufactured of lead or copper-jacketed lead. In a subsonic application, there is very little energy in the moving projectile. Accordingly, a very soft material such as lead is used as the media for expansion. Lead, however, expands erratically, deforming randomly when it comes in contact with any hard surface, be it hide, hair, bone, etc. Once a lead projectile expands, often with a misshapen lump on the front of the projectile, it slows down quickly and changes its path based on the resistance of the misshapen lump at the tip. The expanding subsonic projectile described herein, however, may be monolithic solid copper. The hydraulic ram may be manufactured of copper, aluminum, or other materials. It has been determined that 99.95% pure copper may be utilized effectively for the expanding subsonic projectiles disclosed herein that utilize a hydraulic ram. Similar expansion has been achieved with 99.5% pure copper. Other acceptable materials include copper-jacketed lead, copper-jacketed zinc, copper-jacketed tin, and like materials. The projectile expands only when the hydraulic energy inside the projectile exceeds the tensile strength of the copper. Thus, the projectile only expands when it hits a so-called "wet target." Wet targets include, for example, animals and persons, as well as water (in discharge testing tanks) and gel ordnance test blocks. Thus, the projectiles described herein are barrier-blind to hide, hair, bone, clothing, drywall, car doors, etc. Barriers that would destroy a lead or lead-core projectile are easily breached with a projectile manufactured as described herein. Also, in projectiles where the petals are arranged symmetrically about the axis, the expansion is substantially predictable.

Figure 4A:
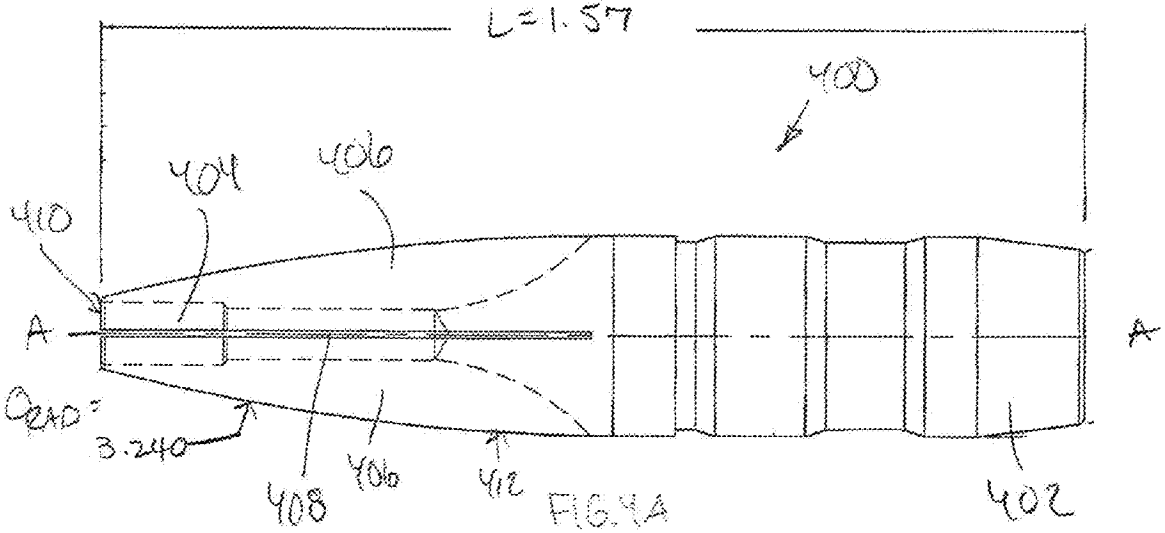
FIGS. 4A-4C depict various views of another embodiment of an expanding subsonic projectile.
Figure 4C:
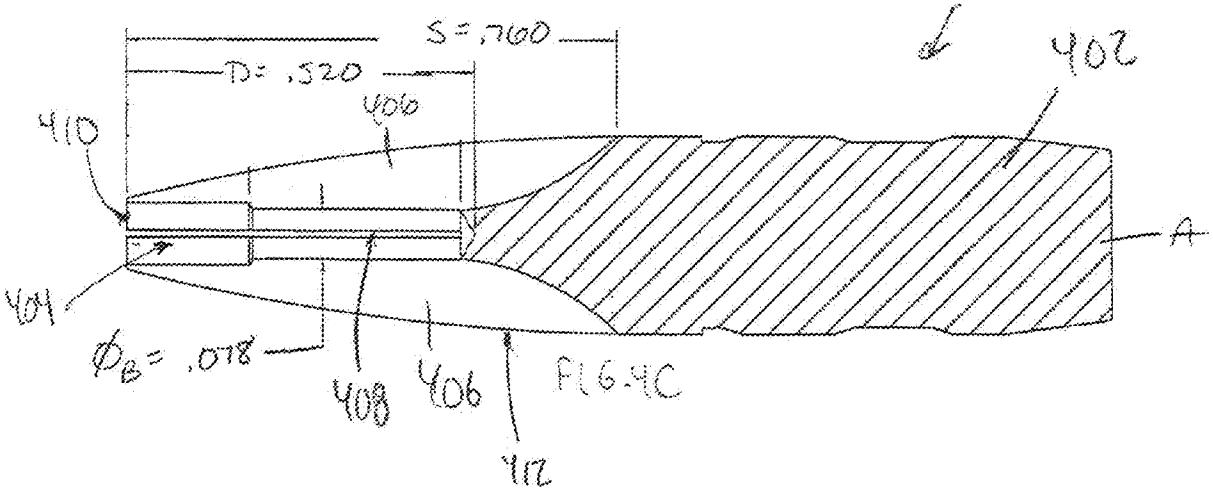
Figure 4B:
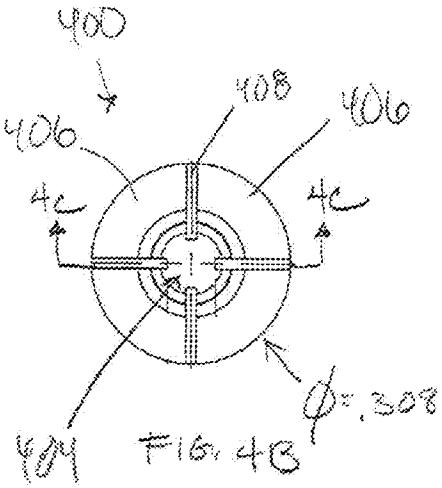

FIGS. 4A-4C depicts another embodiment of an expanding subsonic projectile, in accordance with the technologies described herein. The reference numerals utilized in FIGS. 4A-4C are consistent with those depicted in FIGS. 2A-2D. Accordingly, those elements are generally not described further. Here, the projectile 400 has a body length L=1.57 inches; a body caliber Ø=0.308 inches; a bore depth D=0.520 inches; a bore diameter $Ø_B$=0.078 inches; a slot length S=0.760 inches; and an ogive radius $O_{RAD}$=3.240 inches. Manufacturing tolerances are not reflected in the figures. Thus, for the depicted projectile 400 having an ogive radius of 3.240 inches and a projectile caliber of 0.308 inches, the ogive is about 10.5 calibers, since ogive equals $O_{RAD}$ divided by Ø. An ogive expressed in calibers is scalable. Thus, a projectile having a 0.510 caliber with a 10.5 caliber ogive would have an ogive radius of 5.355 inches (that is, 5.355=10.5×0.510).

The embodiment depicted in FIGS. 4A-4C is particularly useful since the resulting ogive caliber is compatible with magazine feeding in automatic and semi-automatic firearms. In contrast, typical expanding lead or lead-core projectiles must be blunt-shaped, since a larger surface area is generally required for expansion. However, such blunt-shaped projectiles cannot be fed from a magazine. The projectile 400, when utilized in a cartridge having an appropriate casing and primer (such as a 300 Blackout cartridge), can be fed from a magazine of five, 10, 20, 30, and 60 rounds capacity. Expanding subsonic projectiles having other ogive calibers consistent with the present disclosures are also contemplated. For example, ogive calibers of about 8 to about 13 are contemplated. Projectiles having ogives less than about 8 calibers may not feed properly via a magazine, but may be used for single-shot applications, such as in bolt-action rifles and the like. Projectiles having an ogive of greater than about 13 calibers, while able to be magazine fed, may be of insufficient weight to enable the discharging weapon to cycle automatically. Thus, ogives of about 10 calibers to about 13 calibers are also desirable. Ogives of about 10.5 calibers and about 10.59 calibers are also contemplated.

Figure 5A:
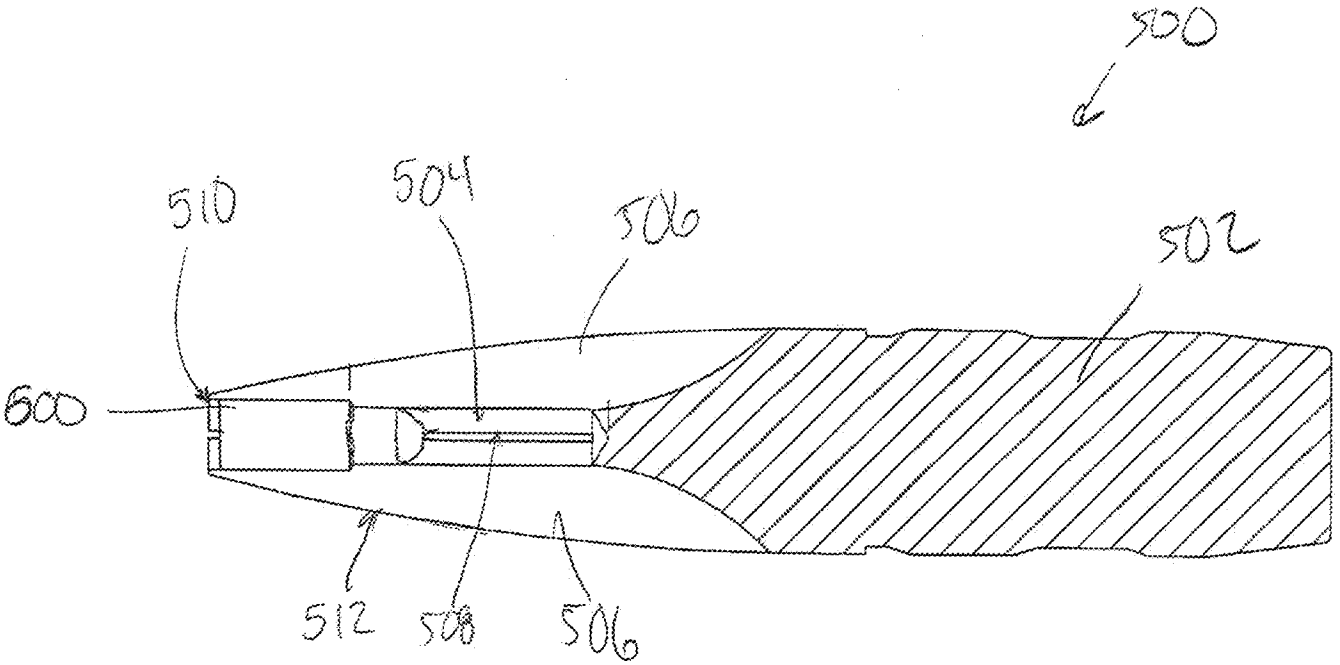
FIGS. 5A-5D depict sectional views of an expanding subsonic projectile in first through fourth states, respectively.
Figure 5B:
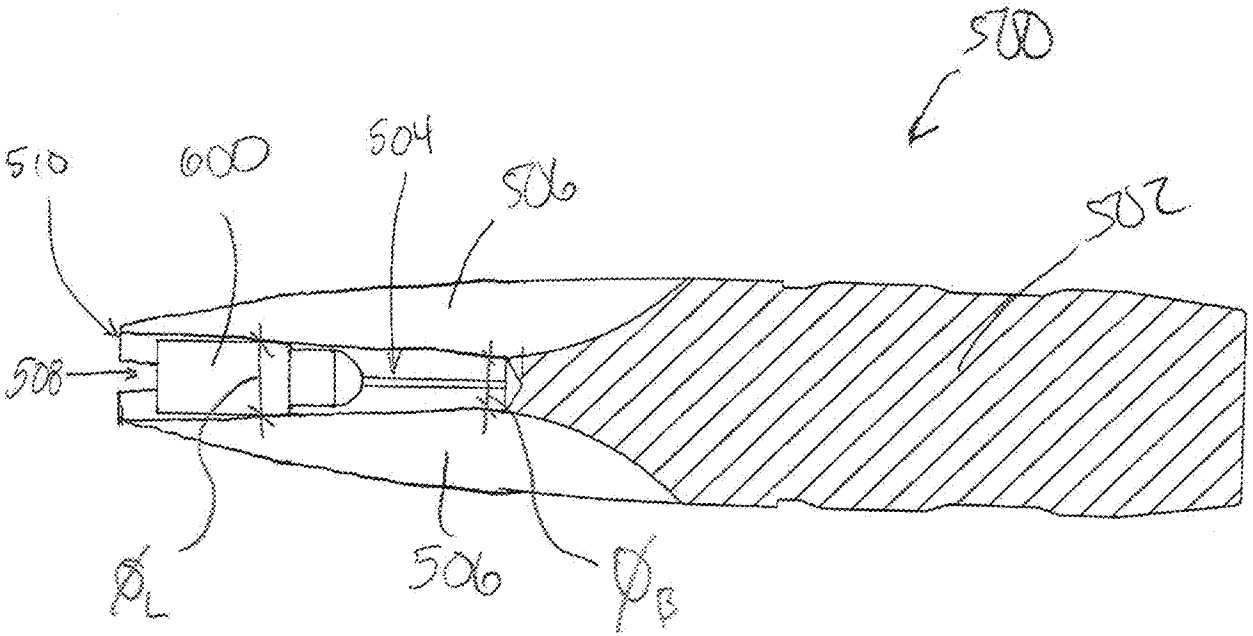
Figure 5C:
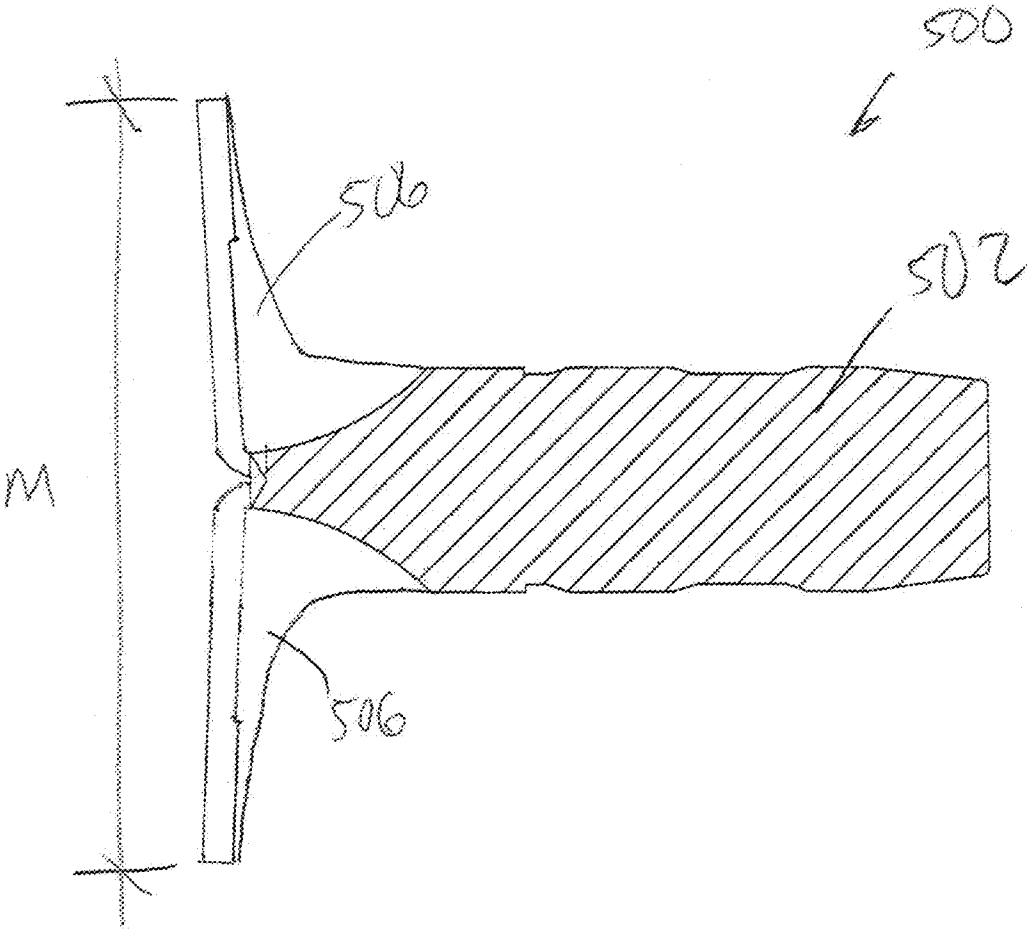
Figure 5D:
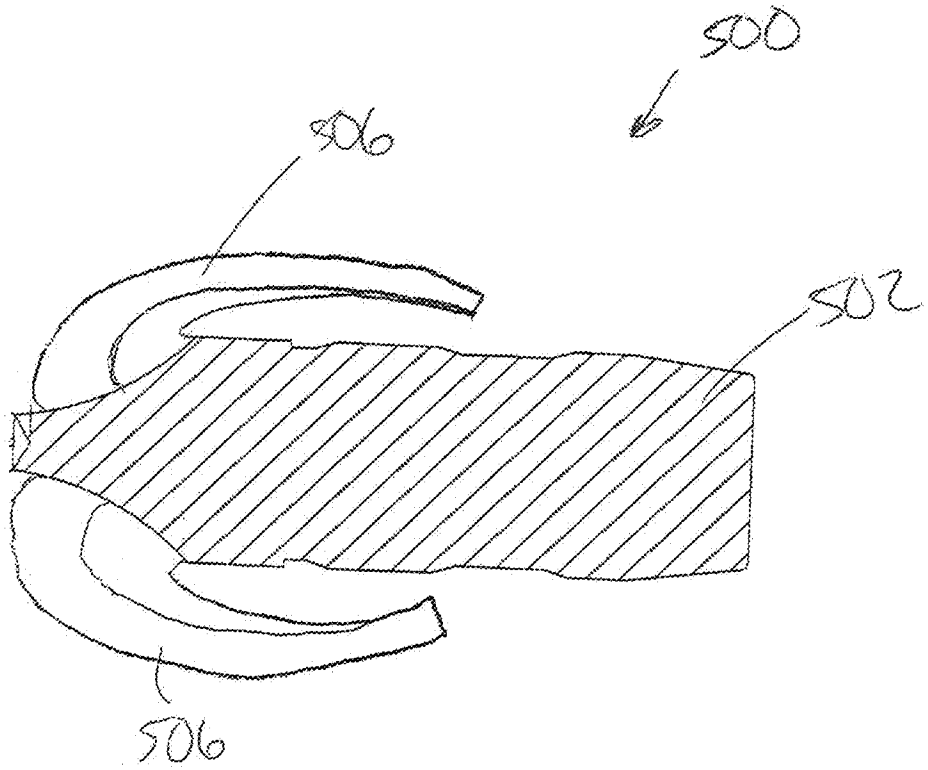

FIGS. 5A-5D depict side sectional views of an expanding subsonic projectile in first through fourth states, respectively. The reference numerals utilized in FIGS. 5A-5C are consistent with those depicted in FIGS. 2A-2D and 3A-3C. Accordingly, those elements are generally not described further. More specifically, FIG. 5A depicts the projectile 500 in a first state, during flight. Here, the ram 600 is disposed within the hollow bore. In certain embodiments, such as the projectile 400 depicted above, the face 602 of the ram 600 may be set back about 0.05 inches from the distal end 510 of the projectile 500. Such a set back provides sufficient volume within the front of the bore 504, proximate the distal end 510, to allow for the build-up of hydrostatic pressure. FIG. 5B depicts the projectile 500 in a second state, at initial petal 506 expansion. Here, hydrostatic forces of the wet target displace the hydraulic ram 600 axially into the hollow bore 504. The leading diameter $Ø_L$, being greater than the bore diameter $Ø_B$, initiates expansion of the petals 506 as the projectile 500 strikes the target. As the petals 506 spread, hydrostatic forces act upon the individual petals 506, spreading them to a third state, depicted in FIG. 5C, which is maximum expansion. The tip-to-tip distance M is depicted is the maximum expansion attained by the projectile 500 after penetration of a target. In certain embodiments, maximum expansion may be about two calibers. Hydrostatic forces will continue to act upon the petals 506 of the projectile 500, pushing them backwards from the direction of penetration, until the projectile 500 stops advancing within the target. FIG. 5D depicts the projectile 500 in a fourth state, at final expansion. In the depicted final expansion state, the petals 506 have completely deformed back against the projectile body 502.

Example

The projectile described in accordance with the present disclosure was discharged at a subsonic velocity from a weapon into a 10% ordnance gelatin test block. The results of this test are presented below.

Test Summary:

A 194 gram projectile was designed for 0.308 subsonic applications in automatic or semi-automatic weapons, or bolt or single-shot weapons with a 1:8 twist or tighter. The subsonic projectile was designed to penetrate approximately 2.0 inches in 10% gel, then expand and penetrate while retaining 100 percent of the initial weight. At the maximum expansion point, the maximum tip-to-tip distance on the petals is 1.4 inches. The ogive profile of the bullet is designed for reliable feeding from AR-style magazines in semi-automatic and full-automatic fire.

Projectile Specification:

| | |
|---|---|
| Weight | 194 gr |
| Length | 1.530" |
| Bc(G1) | 0.638 theoretical, calculated. |

Due to limitations in calculating a ballistic coefficient for a slotted subsonic projectile, the following method was used. The bullet was designed using a fixed density value and the design weight was documented. The bullet is then produced and the actual weight measured. The density value is then modified so the design weight and the actual weight are the same. The ballistic coefficient is calculated from this homogenous density value.

Ordnance Gel Specification:

The projectile was discharged into a 10% ballistic ordnance gelatin test block manufactured and calibrated in accordance with the FBI Ammunition Testing Protocol, developed by the FBI Academy Firearms Training Unit. The base powder material utilized for the 10% ordnance gelatin test block was VYSE™ Professional Grade Ballistic & Ordnance Gelatin Powder available from Gelatin Innovations, of Schiller Park, Ill. The block was manufactured at the test site in accordance with the formulations and instructions provided by the powder manufacturer. After manufacture of the gelatin test block, the test block was calibrated. Calibration requires discharging a 0.177 steel BB at 590 feet per second (fps), plus or minus 15 fps, into the gelatin test block. The test block is considered calibrated if the shot penetrates 8.5 centimeters (cm), plus or minus 1 cm (that is, 2.95 inches-3.74 inches). The calibrated block is then used in the terminal performance testing of the projectile.

Terminal Performance Testing:

| | | |
|---|---|---|
| Shot Velocity | 1,040 | fps |
| Initial Expansion Depth | 2.0" | approximate |
| Temporary Wound Cavity | 8.0" | approximate |
| Maximum Expansion Diameter | 1.4" | approximate |
| Final Expansion Diameter | 1.0" | approximate |
| Total Depth | 14.5"+ | approximate |
| Retained Base Weight | 100% | |

Thus, the expansion of the projectile was greater than about two calibers.

Manufacture of expanding subsonic projectiles consistent with the technologies described herein may be by processes typically used in the manufacture of other projectiles. The projectiles may be cast from molten material. Projections in the mold may form the depicted slots and bore, or the slots and bore may be cut into the projectiles after casting. The projectiles, rams, casings, primers, and propellants may be assembled using one or more pieces of automated equipment. In some embodiments, the rams may be inserted into the projectiles, then shipped to a second location for assembly into a final cartridge.

Unless otherwise indicated, all numbers expressing dimensions, speed, weight, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present technology.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 8 to about 13" should be interpreted to include not only the explicitly recited values of about 8 to about 13, but also include individual values and sub-ranges within the indicated range. Thus, included in this numerical range are individual values such as 9, 10, 10.5, 11.5, etc., as well as sub-ranges such as from 9-13, 10-13, 10.5-11, etc. This same principle applies to ranges reciting only one numerical value. Furthermore, such an interpretation should apply regardless of the breadth of the range or the characteristics being described.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An expanding subsonic projectile comprising:

a body comprising an ogive of greater than about 8 calibers, wherein the body at least partially defines a hollow bore extending for a first axial length from a front distal end of the body; and a hydrostatic ram comprising a leading face and disposed proximate an open end of the bore, wherein the leading face is recessed from the distal end, and wherein the hydrostatic ram comprises a second axial length that is less than the first axial length of the bore such that the hydrostatic ram is moveable rearward within the bore.

2. The expanding subsonic projectile of claim 1, wherein the ogive is in a range from about 8 calibers to about 13 calibers.

3. The expanding subsonic projectile of claim 1, wherein the ogive is in a range from about 10 calibers to about 13 calibers.

4. The expanding subsonic projectile of claim 1, wherein the ogive is about 10.59 calibers.

5. The expanding subsonic projectile of claim 1, wherein the body comprises a plurality of discrete petals, wherein each petal is separated from an adjacent leaf by a slot defined by the body.

6. The expanding subsonic projectile of claim 5, wherein the body comprises three petals.

7. The expanding subsonic projectile of claim 6, wherein the body comprises four petals and the slots disposed between the petals are disposed about an axis of the body at about 0 degrees, about 90 degrees, about 180 degrees, and about 270 degrees.

8. The expanding subsonic projectile of claim 1, wherein the projectile is adapted to expand greater than about 2 calibers when the projectile is discharged from a firearm at a subsonic speed into a wet target.

9. The expanding subsonic projectile of claim 1, wherein the hydrostatic ram is adapted to move axially within the bore when the projectile is discharged from a firearm at a subsonic speed into a wet target.

10. The expanding subsonic projectile of claim 1, wherein the projectile comprises a monolithic construction.

11. The expanding subsonic projectile of claim 1, wherein the hydrostatic ram comprises a leading diameter and the bore comprises a bore diameter smaller than the leading diameter.

12. A cartridge comprising:

a casing;

a primer disposed at a first end of the casing;

a projectile disposed at a second end of the casing, wherein the projectile comprises:

a body comprising an ogive of greater than about 8 calibers, wherein the body at least partially defines a hollow bore extending for a first axial length from a front distal end of the body; and a hydrostatic ram comprising a leading face disposed proximate an open end of the bore in a tight circumferential fit, wherein the leading face is recessed from the distal end, and wherein the hydrostatic ram comprises a second axial length that is less than the first axial length of the bore such that the hydrostatic ram is moveable rearward within the bore.

13. The cartridge of claim 12, wherein the body comprises a body length and the bore comprises a bore depth about one-third of the body length.

14. The cartridge of claim 13, wherein the body comprises a plurality of adjacent petals, wherein adjacent petals at least partially define a slot therebetween.

15. The cartridge of claim 14, wherein each slot defines a radius extending from the bore to an outer surface of the body.

16. The cartridge of claim 15, wherein the slot defines a slot length and wherein the bore depth is about two-thirds of the slot length.

17. The cartridge of claim 16, wherein the slot length is about one-half of the body length.

18. The cartridge of claim 12, wherein the hydrostatic ram is adapted to move axially within the bore when the projectile is discharged from a firearm at a subsonic speed into a wet target.

19. The cartridge of claim 12, wherein the projectile is adapted to expand greater than about 2 calibers when the projectile is discharged from a firearm at a subsonic speed into a wet target.

20. An expanding subsonic projectile comprising:

a body comprising an ogive of greater than about 8 calibers, wherein the body at least partially defines a hollow bore extending a first axial length from a front distal end of the body, wherein the body comprises a plurality of discrete petals and each petal is separated from an adjacent leaf by a slot extending a second axial length from the distal end and defined by the body; and a hydrostatic ram disposed proximate an open end of the bore and recessed from the distal end, wherein the hydrostatic ram comprises a third axial length that is less than both the first and second axial lengths.

21. The expanding subsonic projectile of claim 20, wherein the ogive is in a range from about 8 calibers to about 13 calibers.

22. The expanding subsonic projectile of claim 20, wherein the hydrostatic ram comprises a leading diameter and the bore comprises a bore diameter smaller than the leading diameter.

23. The expanding subsonic projectile of claim 20, wherein at least one of the body and the hydrostatic ram is formed from a material comprising approximately 99.5% pure copper.

* * * * *